US006116924A

United States Patent [19]

Laut

[11] Patent Number: 6,116,924

[45] Date of Patent: Sep. 12, 2000

[54] ELECTROMAGNETIC EMISSIONS SHIELDING STRUCTURE FOR CIRCUIT BOARD CONNECTOR ASSEMBLY

[75] Inventor: Marvin Laut, Dracut, Mass.

[73] Assignee: 3COM Corporation, Santa Clara, Calif.

[21] Appl. No.: 09/318,166

[22] Filed: May 25, 1999

[51] Int. Cl.[7] ..... H01R 4/66

[52] U.S. Cl. ..... 439/95; 361/818

[58] Field of Search ..... 439/76.1, 95, 97, 439/92, 607, 609; 361/816, 818

[56] References Cited

U.S. PATENT DOCUMENTS

| | | | |
|---|---|---|---|
| 3,594,688 | 7/1971 | Muska | 439/97 |
| 4,518,209 | 5/1985 | Negley | 439/92 |
| 5,085,590 | 2/1992 | Galloway | 439/95 |
| 5,130,896 | 7/1992 | Babb et al. | 361/818 |
| 5,266,053 | 11/1993 | Jamet et al. | 439/607 |
| 5,496,195 | 3/1996 | Reed | 439/607 |
| 5,684,340 | 11/1997 | Soler et al. | 307/91 |
| 5,709,569 | 1/1998 | Buck et al. | 439/607 |

*Primary Examiner*—Khiem Nguyen
*Assistant Examiner*—Son V. Nguyen
*Attorney, Agent, or Firm*—McGlew and Tuttle, P.C.

[57] ABSTRACT

An assembly is provided including a printed circuit board, a faceplate and a connector. The connector provides a media interface for connections through the circuit board. The printed circuit board is provided with a ground plane over a ground plane region. The faceplate includes a faceplate extension extending from a front faceplate region to the ground plane region of the PCB. The faceplate extension includes a ground plane contact portion in contact with the ground plane.

9 Claims, 3 Drawing Sheets

ELECTROMAGNETIC EMISSIONS SHIELDING STRUCTURE FOR CIRCUIT BOARD CONNECTOR ASSEMBLY

FIELD OF THE INVENTION

The invention relates generally to assemblies with at least one printed circuit board and one or more connectors and more particularly to such an assembly with a faceplate particularly useful as a card for a slot of an electronic device such as a LAN (local area network) hub or as a card for a lot of a PC or other similar device.

BACKGROUND OF THE INVENTION

Assemblies with circuit boards, connectors and faceplates have been used extensively.

Personal computers are provided with connections to the motherboard or other computerboard such that devices may be connected or disconnected from the basic unit. The assemblies are connected to the main device for providing an additional function, such as a modem function etc.

Concentrators and hubs for local area network systems are typically provided with a main housing wherein cards are disposed in slots of the housing to provide the necessary functional components. Media access cards typically provide several connection interfaces (connectors). The assemblies typically include a faceplate, connectors and at least one printed circuit board.

The arrangement of numerous connectors in a small physical region can cause problems with respect to the electromagnetic emissions of the various devices. The electromagnetic interference (EMI) can cause problems. At higher frequencies, the problems of the electromagnetic interference becomes greater.

SUMMARY AND OBJECTS OF THE INVENTION

It is an object of the invention to provide a PCB, faceplate connector assembly which provides a shielding function in the region of the connector.

According to the invention, an assembly is provided including a printed circuit board, a faceplate and a connector. The connector provides a media interface for connections through the circuit board. The printed circuit board is provided with a ground plane or an electrical medium ground conductor over a ground plane region, including exposed surface sites. The faceplate includes a faceplate extension extending from a front faceplate region to the ground plane region of the PCB. The faceplate extension includes a ground plane contact portion in contact with the ground plane.

The faceplate extension advantageously extends along a portion of the PCB, preferably substantially in parallel thereto. The faceplate extension may include a flange for physically securing the PCB to the faceplate to provide additional physical support. A gasket element is preferably provided in contact with the faceplate extension over a section of the faceplate extension. This gasket preferably is also in contact with the ground plane along the ground plane section. The contact area between the faceplate extension and the ground plane may be of a dimension which extends fully over a corresponding dimension of the connector and even more preferably from, for example, above the first connector to below the last connector of a plurality of connectors disposed along the faceplate.

The faceplate preferably further includes a second faceplate extension extending substantially perpendicular from the faceplate front portion and substantially in parallel to the first faceplate extension.

The connectors are advantageously one of an RJ type connector (e.g. EIA/TIA Category 5, Category 6, etc.), a Telco connector a coaxial connector etc. The connectors are preferably each mounted to the circuit board physically and also provided with electrical connections to the circuit board (e.g. a plurality of electrical conductors providing transmission paths from a contact region) (e.g. as part of a socket) to transmission paths of the circuit board. The circuit board may for example include connections to the backplane of a communications hub (e.g. concentrator for a local area network) or may be connected to a motherboard or other similar device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
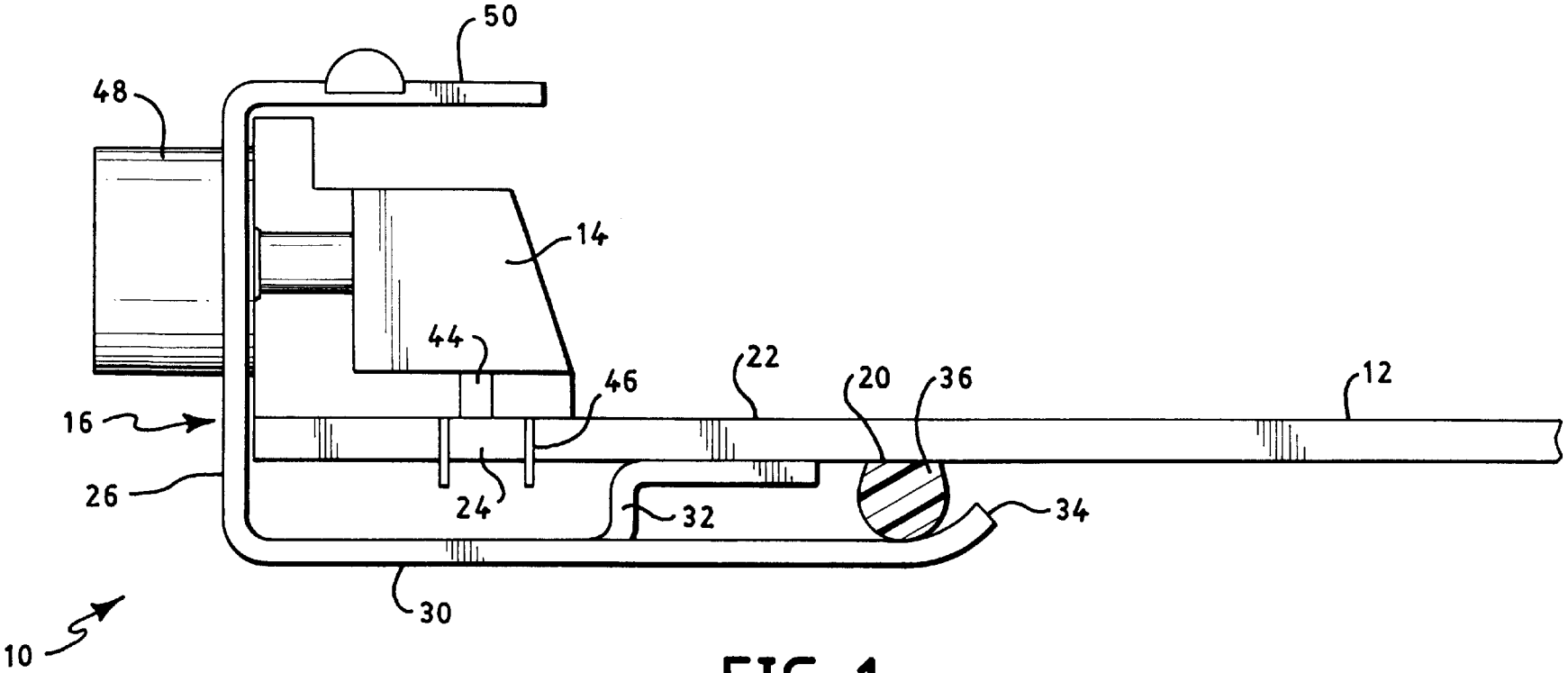
FIG. 1 is a top view of a printed circuit board faceplate and connector assembly according to the invention.

Referring to the drawings in particular, the invention comprises an assembly generally designated 10 which includes a printed circuit board 12, a connector 14 and a faceplate 16.

The printed circuit board 12 includes a ground plane 20 connected to ground for the device (such as the supply ground of a concentrator or hub). The ground plane is exposed at least at ground plane sites 21 The printed circuit board also includes circuitry such as traces and or plated through holes and/or other connected components. The printed circuit board 12 is connected to some other device (such as the backplane of a local area network concentrator, the motherboard of a personal computer, etc.). The printed circuit board 12 also includes connection support regions for physical connection to the faceplate 16 and one or more of connector 14. The connector includes a built in shielding structure (preferably at least at its rear side).

Faceplate 16 includes a front faceplate portion 26. This can either be the faceplate which is viewable from outside of the main device or a base for a decorative cover plate may be provided in addition. The faceplate 16 has a faceplate extension 30 which extends along a side of the printed circuit board for a distance, substantially in parallel to the circuit board. The faceplate extension 30 may include a support flange 32 allowing a connection at portion 22 with the support flange 32.

Figure 3:
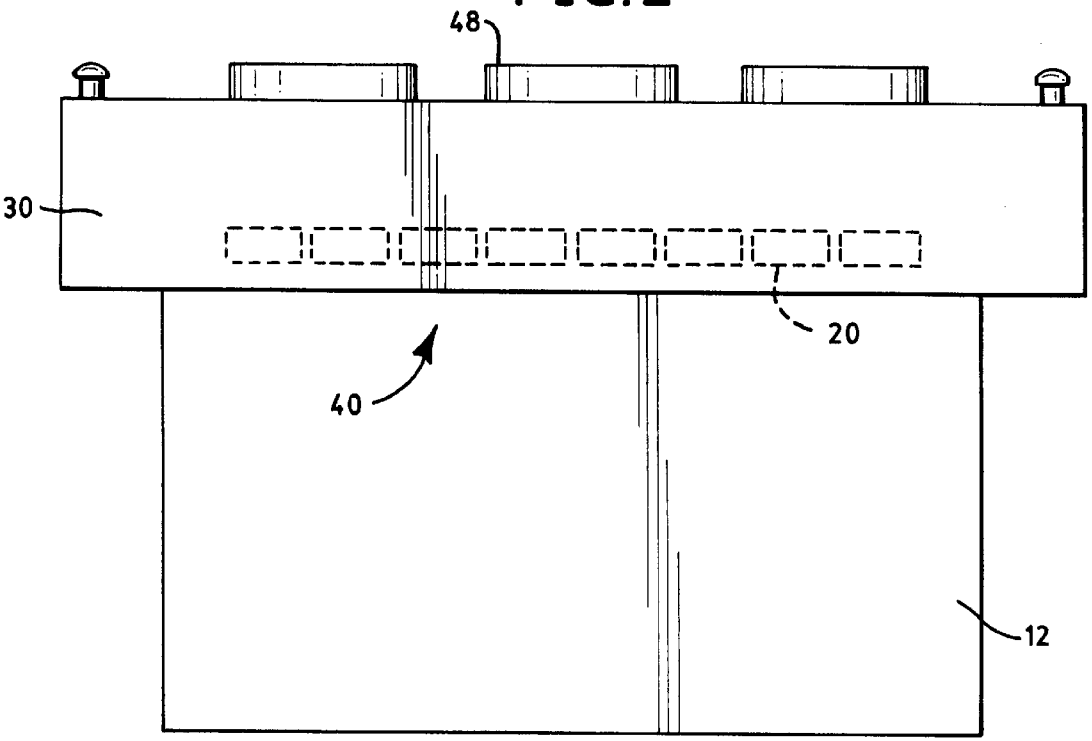
FIG. 3 is a side view of the device of FIG. 1.

At an end of the faceplate extension, a contact surface 34 is provided. Preferably a gasket 36 is provided for providing a sealed surface based on the contact between the ground plane 20 and the gasket 36 on the one side and the gasket 36 and the contact surface 34 on the other side. This sealed surface can extend along a contact sealing section 40 as shown in FIG. 3.

Each connector 14 includes a physical connection 44 to portion 24 of the PCB 12 as well as a plurality of conductors 46 providing transmission paths. The connector also includes a physical media interface (such as a socket assembly 48). The socket assembly extends to the front side of faceplate 26 as shown in FIG. 1.

The faceplate 16 preferably also includes a second faceplate extension 50 which extends substantially in parallel to the extension 30. It is also possible to provide individual shielding plates which are disposed between the connectors 14 (extending horizontally for example from left to right in FIG. 2). Such additional shield elements may also be connected to the ground plane 20 and further shielding for the open rear side of the connector may also be provided. However, according to the preferred embodiment, a shielding enclosure is primarily provided on each side of the connector as discussed above.

Figure 2:
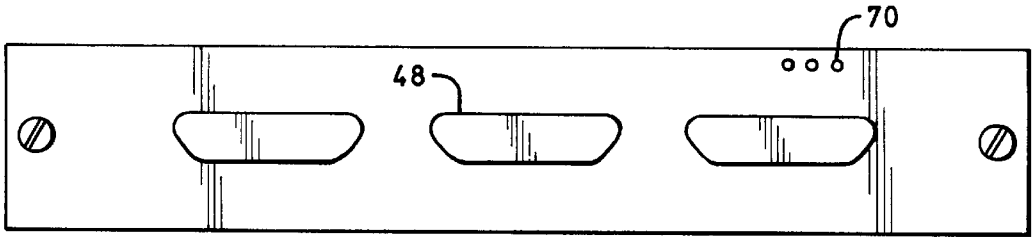
FIG. 2 is a front view of the device of FIG. 1.

FIG. 2 shows the front of the faceplate 16. This can again can be covered by a decorative plate. The faceplate may also have other elements which can be seen through openings in the faceplate such as LED indicators 70.

Figure 4:
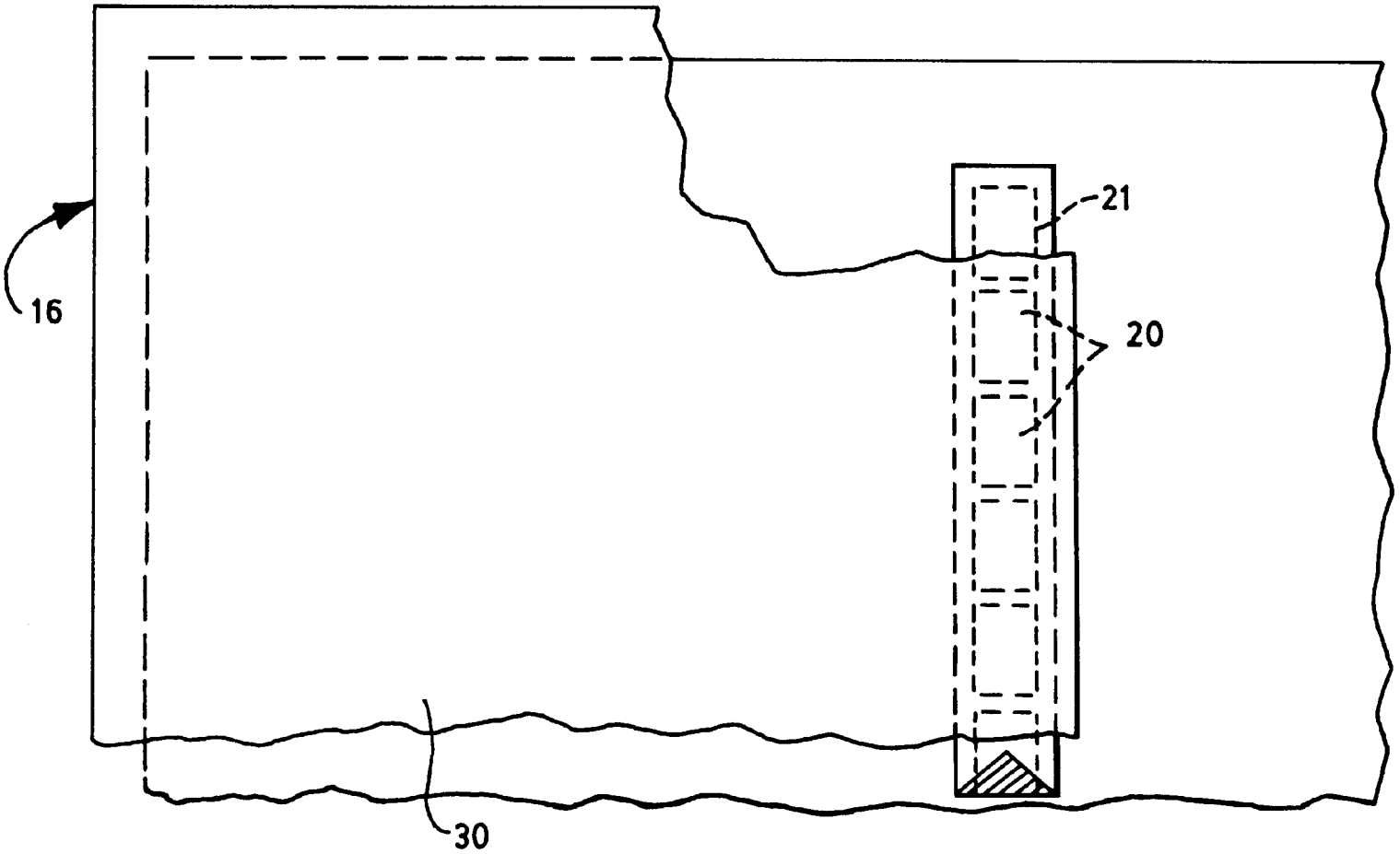
FIG. 4 is partial cut away view showing a portion of the circuit board, a portion of the connection gasket and a portion of the faceplate.

FIG. 4 is an exploded view which helps explain the process forming the faceplate. The gasket element 36 is applied to the contact surface 34. The gasket may also be applied to the ground plane 20. After the gasket 36 is applied to the surface 34 (by adhesive or some other means) the printed circuit board is connected to the flange 32 to hold the faceplate 16 together with the PCB 12. This results in the gasket being pressed against the ground plane 20 which provides the shielding structure. Advantageously the connectors 14 are already disposed on the printed circuit board 12, namely physically connected to the printed circuit board as well as divided with electrical connections.

Faceplate 16 is preferably a sheet metal piece which is appropriately punched to provide the openings for socket assembly 48 and to provide any other openings which may be required. The flange 32 is formed and the necessary bends to form the faceplate extension 30 and faceplate extension 50 are provided. Additionally, the contact surface 34 is also formed.

While specific embodiments of the invention have been shown and described in detail to illustrate the application of the principles of the invention, it will be understood that the invention may be embodied otherwise without departing from such principles.

What is claimed is:

1. A faceplate and circuit board assembly, comprising:

a printed circuit board with an electrical medium ground plane;

a connector electrically connected to the circuit board at a connection support region of the circuit board;

said faceplate, said connector being connected to said faceplate; and a faceplate extension connected to said faceplate and connected to said ground plane at a contact surface of the circuit board that is beyond the connection support region of the circuit board to provide a ground shield that is integral to the faceplate and circuit board assembly to protect the connector from electromagnetic radiation.

2. The faceplate and circuit board assembly according to claim 1, wherein said faceplate includes another faceplate extension, on a side of said connector which is opposite to said faceplate extension, said another faceplate extension extending substantially in parallel to said printed circuit board and to said faceplate extension.

3. A faceplate and circuit board assembly according to claim 1, wherein said connector includes a connector shield, and said face plate includes another faceplate extension, said faceplate, said faceplate extension, said connector shield, and said another faceplate extension cooperating to define a grounded enclosure.

4. A faceplate and circuit board assembly according to claim 1, wherein said connector includes a physical connection physically connecting said connector to said printed circuit board.

5. A faceplate and circuit board assembly according to claim 1, wherein said connector includes a socket portion extending through a front face of said faceplate.

6. A process for forming a faceplate, connector and printed circuit board assembly, comprising:

providing a printed circuit board with a ground plane;

physically connecting said connector to said printed circuit board at a connection support region of the circuit board and connecting conductors of said connector to conductive paths of said printed circuit board;

providing a faceplate including a faceplate extension extending substantially perpendicular to a front face plate plane;

bending a portion of said faceplate extension out of a plane of said faceplate extension and connecting said portion to said printed circuit board; and providing a connection between said faceplate extension and said ground plane at a contact surface of the circuit board that is beyond the connection support region of the circuit board to provide an integral ground shield for limiting electromagnetic interference in the connection support region of said connector.

7. A process according to claim 6, further comprising providing said connection between said faceplate extension and said ground plane by connecting an electromagnetic emission reducing gasket to said faceplate extension and connecting said gasket to said ground plane.

8. A process for forming a faceplate, connector and printed circuit board assembly, comprising:

providing a printed circuit board with an electrical medium ground plane with exposed portions at a contact surface of the circuit board that is beyond a connection support region of the circuit board;

physically connecting said connector to said printed circuit board at the connection support region of the circuit board and connecting conductors of said connector to conductive paths of said printed circuit board;

providing said faceplate including a faceplate extension extending substantially perpendicular to a front face plate plane; and providing a connection between said faceplate extension and said exposed portions to provide an integral ground shield for limiting electromagnetic interference in the connector support region of said connector.

9. The process for forming a faceplate, connector and printed circuit board assembly according to claim 8, further comprising:

bending a portion of said faceplate extension out of a plane of said faceplate extension and physically connecting said portion to said printed circuit board.

* * * * *